United States Patent [19]

Riedl

[11] Patent Number: 4,811,930

[45] Date of Patent: Mar. 14, 1989

[54] OVERHANG ARMS FOR RACK AND PINION JACK OF A LIFTING AND DEPOSITING DEVICE FOR TRANSPORTABLE LARGE CONTAINERS OR THE LIKE

[75] Inventor: Reinhold Riedl, Miltenberg, Fed. Rep. of Germany

[73] Assignee: haacon hebetechnik gmbh, Freudenberg/Main, Fed. Rep. of Germany

[21] Appl. No.: 79,955

[22] Filed: Jul. 31, 1987

[30] Foreign Application Priority Data

Aug. 23, 1986 [DE] Fed. Rep. of Germany ..... 3628700

[51] Int. Cl.[4] ..... B66F 7/26

[52] U.S. Cl. ..... 254/45; 254/95

[58] Field of Search ..... 254/133 R, 134, 45, 254/100, DIG. 4, 95, 96, 97

[56] References Cited

U.S. PATENT DOCUMENTS

| | | | |
|---|---|---|---|
| 1,457,195 | 5/1923 | Souders | 254/133 R |
| 2,945,662 | 7/1960 | Jennings | 254/100 |
| 3,753,550 | 8/1973 | Criswell | 254/133 R |
| 3,802,664 | 4/1974 | Edwards | 254/134 |
| 4,669,704 | 6/1987 | Abraham et al. | 254/100 |
| 4,708,319 | 11/1987 | Cruz | 254/45 |

FOREIGN PATENT DOCUMENTS

| | | | |
|---|---|---|---|
| 750759 | 6/1956 | United Kingdom | 254/133 R |

*Primary Examiner*—Robert C. Watson

*Attorney, Agent, or Firm*—Frank P. Presta

[57] ABSTRACT

Lifting and depositing devices for transportable large containers should be dismountable into individual parts of relatively low weight per part for simplification of their handling. So that this is also true of relatively long overhang arms of the rack and pinion jacks of such devices, each overhang arm is configured generally in the shape of a wrench having a narrow middle part and forked end parts, and is of generally flat construction, so that its greatest structural height corresponds only approximately to the structural height of the winch assembly. The overhang arms thus have a relatively narrow, lightweight middle portion and because of the flat construction following dismounting of the winch assembly and support legs they have the desired light weight per piece.

6 Claims, 3 Drawing Sheets

12
10
17
16
15
14
18
26
19
20
25
23

12
10
16
17
15
14'
18
26'
19'
23
20'
25

OVERHANG ARMS FOR RACK AND PINION JACK OF A LIFTING AND DEPOSITING DEVICE FOR TRANSPORTABLE LARGE CONTAINERS OR THE LIKE

BACKGROUND OF THE INVENTION

The present invention relates to overhang arms for rack and pinion jacks of a lifting and depositing device for transportable large containers or the like, in which the rack tracks of the winch assemblies are arranged on support legs for the large containers and the overhang arms are to be fastened to connecting beams at the corners of the large container, and furthermore, viewed from above, the overhang arms have a U-shaped mounting space on the one end for tight fitting reception and incorporation of a connecting beam and a U-shaped guide space at the other end for a support leg with rack track. The large containers can be, for instance, containers, shelters or compartments. However, the device is also suitable for the lifting and depositing or support of worksite huts or the like.

An overhang arm of the above type is known from German Utility Pat. No. 82 35 609. This relatively short arm consists of two C-shaped plates open to the side, which are fastened to a spacing member placed between them. The winch is mounted on the outside of one plate, and its driving pinion projects into the guide space at the one end of the arm and engages with the rack track on the support leg. As a result of the tight construction of the winch, this arm is of relatively great weight, which would be increasingly more difficult with greater arm lengths, as are required, for example, for the loading and unloading of large containers into and from cargo aircraft. It is to be emphasized that after the lifting and depositing device has been used, it can be disassembled into individual parts of relatively low individual weight, so that these parts can be transported and stowed relatively easily.

A lifting and depositing divide for transportable large containers is also known from German Pat. No. 32 24 890, in which overhang arms are used, to which the winch assemblies are detachably fastened by means of cotter pins, so that they can be removed from the overhang arms after termination of the use of the lifting and depositing device. The overhang arms of this known device, however, are not suitable for fastening to the connecting beams on the sides of the container.

SUMMARY OF THE INVENTION

The object of the invention is to further develop an overhang arm of the aforementioned structural type, so that even when it is relatively long it is still quite light in weight and thus is simple to handle and maneuver.

According to the present invention this is attained in that:

(a) each overhang arm is constructed in the shape of a wrench having forked ends or the like, and is flat, so that its greatest structural height only approximately corresponds to the structural height of the winch assembly; and (b) the winch assembly is incorporated in a known manner in a part of the U-shaped guide space for a support leg with a rack track.

Because it is shaped like a wrench, this overhang arm has a relatively narrow lightweight middle portion and, in connection with the flat construction, following removal of the winch assembly, a light weight is obtained which is acceptable for handling. Furthermore, it is important that the arm can be produced even in greater lengths with practically no loss of the above advantages, as is required for the loading and unloading of large containers into and from cargo aircraft.

One preferred embodiment of the invention is characterized in that the greatest structural height of the overhang arm on its connection side Y is smaller than or equal to 0.8 times X, in which X stands for the length of the overhang arm from its connection end to an inner side of the U-shaped guide space for a support leg with a rack track.

Still another embodiment of the invention, which broadens the range of uses of the overhang arm and thus also of the entire device, is characterized in that the attachment or mounting space and the guide space, viewed from above, are arranged at a right angle to each other.

BRIEF DESCRIPTION OF THE DRAWINGS

The invention is explained in some detail hereinafter relative to the drawings of exemplary embodiments wherein.

DESCRIPTION OF THE PREFERRED EMBODIMENTS

Figure 1:
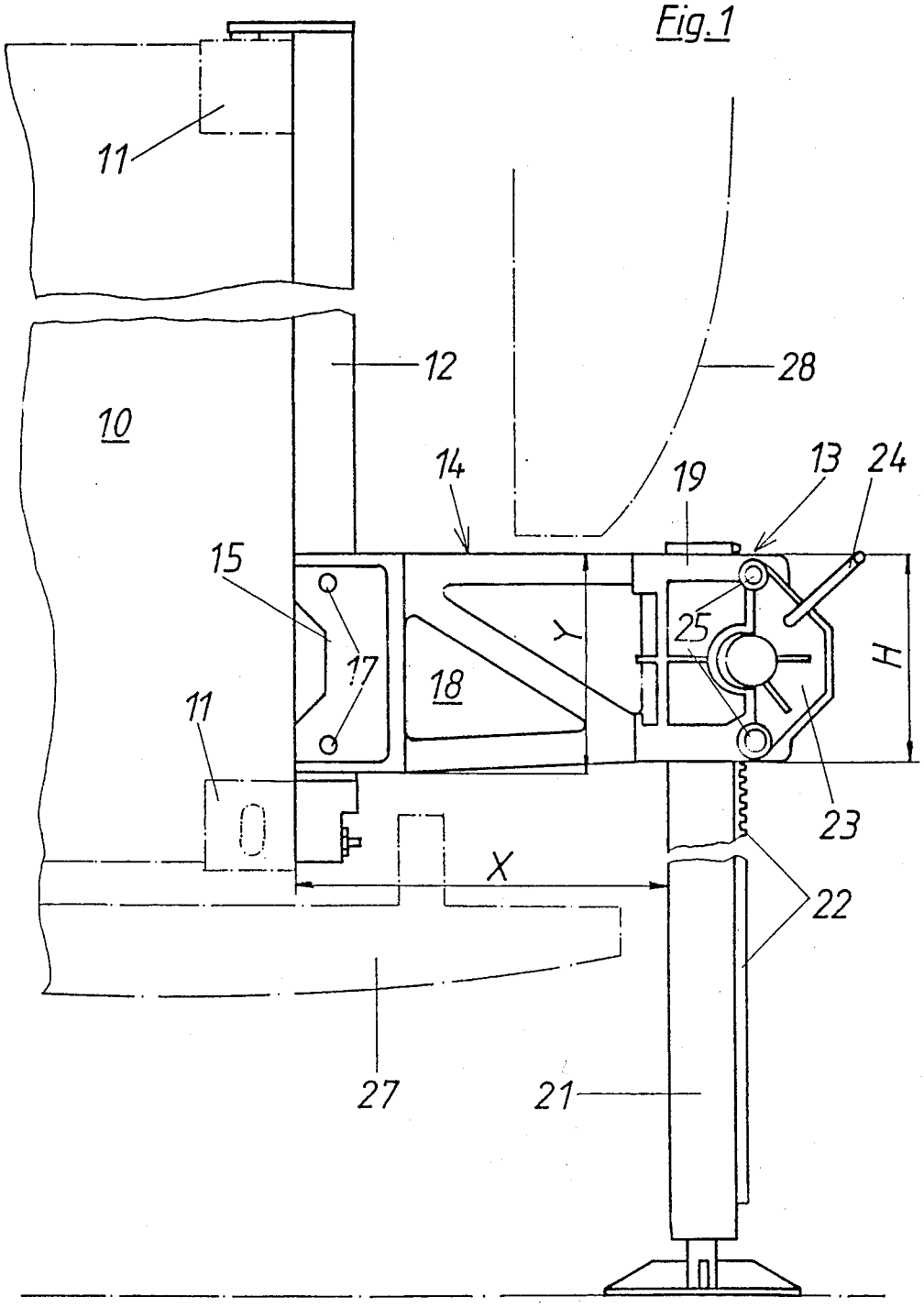
FIG. 1 is a front elevational view of a part of a raised, large container with a connecting beam mounted at one corner of the container, to which is attached an overhang arm for a rack track and winch which form a rack and pinion jack, of which the support leg is mounted on the ground, in which a body part in the area of the loading ramp are indicated in broken lines.

The large container 10 to be lifted and deposited or even to be deposited at some distance from the ground has a rectangular section and has top and bottom standardized corner fittings 11 on its four corners, to each of which is detachably fastened a connecting beam 12. Connecting beams 12 consist of pipes which may be of quadratic section (see and compare FIGS. 2 and 3). A rectangular, round or polygonal, e.g. 6-cornered, shape is also possible.

The lifting and depositing device for large container 10 has four separate rack and pinion jacks 13, which can be detachably connected with connecting beams 12 by overhang arms 14. Each overhang arm 14 comprises a casting or the like in the shape of a wrench having a narrow middle part 18 and forked end parts 15 and 19 viewed from above, arms 14 have a forked connecting part 15 with a U-shaped attachment space, with which arm 14 can be slipped with tight fitting onto a connecting beam 12 and can be attached detachably to the beam by means of two cotter pins 17. Cotter pins 17 extend through corresponding boreholes in beam 12 and in forked connecting part 15. Forked connecting part 15 tapers toward the middle and merges with a relatively narrow middle part 18, which carries another forked part 19 at its outer end with a U-shaped guide space 20 for a support leg 21.

A rack track 22 is fastened parallel to the axis on the outside of each support leg 21, which engages in a driving pinion (not shown) of a winch 23, which can be operated by a manual crank 24. Winch 23 is incorporated detachably by means of two cotter pins 25 in a part of the U-shaped guide space 20 and closes this off from the outside, whereupon the support leg 21 consisting of a rectangular pipe is held on all sides. Cotter pins 25 extend through boreholes (not shown) in forked part 19 and in the winch housing.

Figure 2:
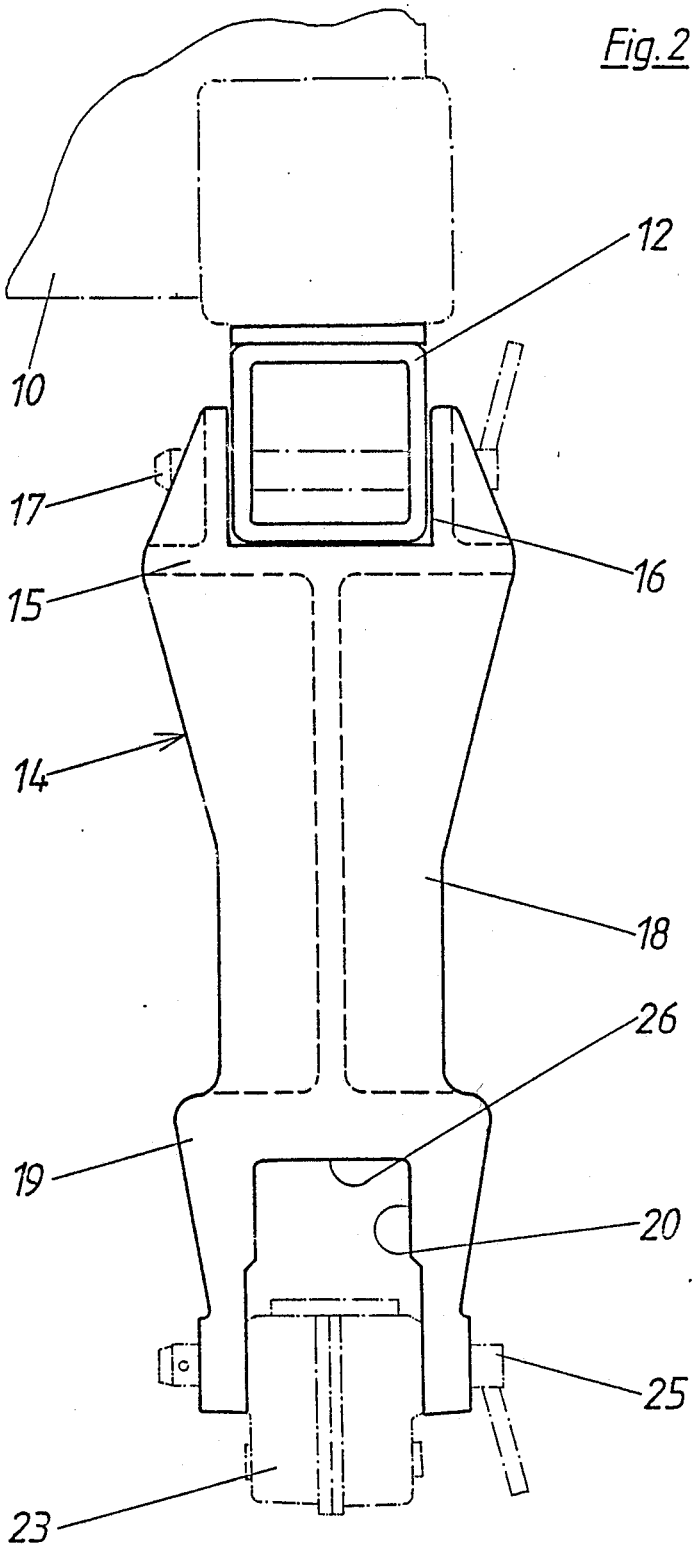
FIG. 2 is a plan view of the overhang arm shown in FIG. 1 in larger scale.
Figure 3:
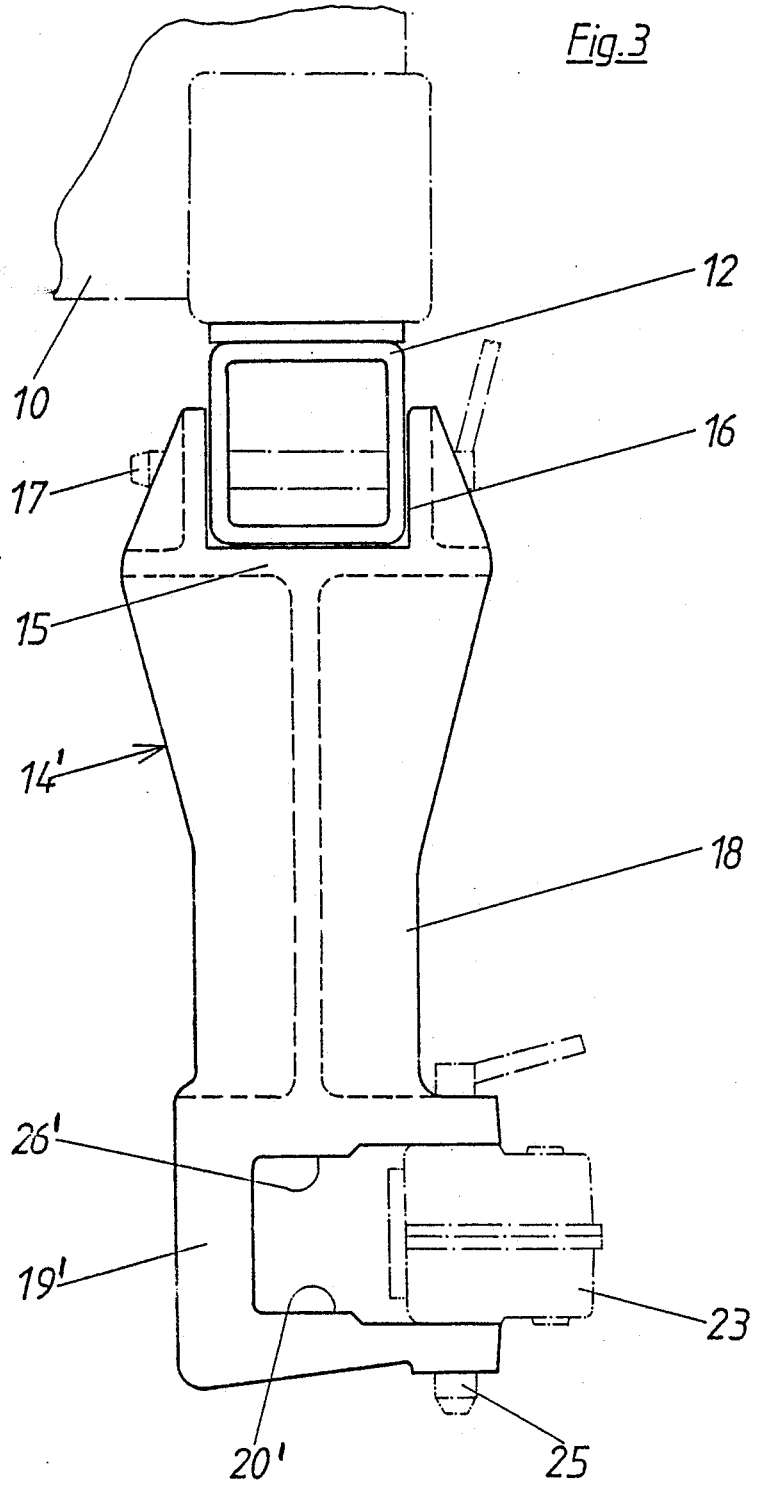
FIG. 3 is another plan view of a different embodiment of the overhang arm according to the present invention.

The overhang arm 14' shown in FIG. 3 corresponds essentially to that of FIGS. 1 and 2 with the exception that the forked part 19' is arranged with its guide space 20' for a support leg 21 at a right angle to forked part 15 and/or attachment or mounting space 16. Thus, two winches 23 could be drive-connected by means of a shaft (not shown), e.g. along a short side of large container 10 so that only one manual crank 24 need be turned for its operation.

It is furthermore important that arms 14 or 14' be constructed very flat, such as in the exemplary embodiment shown in FIG. 1 wherein its greatest height Y on the forked connecting part 15 only slightly exceeds the structural height H of winch 23. In the exemplary embodiment of FIGS. 1 to 3, the greatest structural height Y of overhang arms 14 and 14': Y is smaller than or equal to 0.8 times X. In this case X means the length of overhang arm 14 or 14' from its connected end to one of its inner sides 26 or 26' of U-shaped guide space 20 or 20'. Because of this flat construction, overhang arms 14 and 14' are especially suited for lifting and depositing devices, which are used for loading and unloading large containers 10 into and from cargo aircraft. An intermediate space of limited height is all there is available between a loading ramp 27 and part 28 of the aircraft body in the area of the rear loading opening of these aircraft, to receive the arm 14, as is indicated in FIG. 1.

Overhang arms 14 or 14' which have just been described are attached with their winch assemblies 23 in identical structures on the four connecting beams 12 associated with the corners of large container 10. Two facing winches 23 are in turn drive-connected preferrably by a shaft, so that only two manual cranks 24 must be turned synchronously for the lifting or lowering of large container 10. Thus, according to the turning direction of manual cranks 24, arms 14 or 14' can be correspondingly raised or lowered along support legs 21, whereupon large container 20 can be correspondingly raised or lowered. However, it is also possible to prop up a large container 10 which is raised up over arms 14 or 14' on support legs 21.

What is claimed is:

1. A lifting an depositing device for a transportable large container or the like having a connecting beam at a corner thereof, comprising a support leg having a rack track thereon, a winch movably mounted on said support leg in engagement with said rack track, and an overhang arm adapted to be connected at one end to the connecting beam and at the other end to said winch, the overhang arm having a U-shaped attachment space at said one end for receiving the connecting beam therein in substantially tight-fitting engagement therewith, and a U-shaped guide space at the other end thereof for said support leg, characterized in that:

(a) each overhang arm (14) is configured generally in the shape of a wrench having a narrow middle part and forked end parts defining said attachment space and said guide space, and is of generally flat construction, so that its greatest structural height (Y) corresponds approximately to the structural height (H) of the winch (23), and (b) the winch (23) is adapted to be detachably connected to the overhang arm and disposed in one part of the U-shaped guide space (26) for said support leg (21).

2. The lifting and depositing device of claim 1 wherein the one end of said overhang arm and the connecting beam are provided with first boreholes therein that are adapted to the aligned when the connecting beam is positioned within said U-shaped attachment space, and first cotter pins are insertable through said first boreholes to releasably connect the one end of said overhang arm to the connecting beam.

3. The lifting and depositing device of claim 2 wherein the other end of said overhang arm and the winch are provided with second boreholes therein that are adapted to be aligned when said winch is positioned in said guide space, and second cotter pins are insertable through said second boreholes to releasably connect the other end of said overhang arm to said winch.

4. Lifting and depositing device as in claim 1 characterized in that the greatest structural height Y of the overhand arm (14) is smaller than or equal to 0.8 times X, in which X stand for the length of the overhand arm (14) from its one end to one inner side (26) of the U-shaped guide space (20) at the other end thereof.

5. Lifting and depositing device as in claim 1, characterized in that the attachment space (16) and the guide space (20), viewed from above, are arranged at a right angle to each other.

6. Lifting and depositing device as in claim 4, characterized in that the attachment space (16) and the guide space (20), viewed from above, arranged at a right angle to each other.

* * * * *

UNITED STATES PATENT AND TRADEMARK OFFICE

CERTIFICATE OF CORRECTION

PATENT NO. : 4,811,930

DATED : Mar. 14, 1989

INVENTOR(S) : Reinhold Riedl

It is certified that error appears in the above—identified patent and that said Letters Patent is hereby corrected as shown below:

Column 4, line 25, delete "the" and insert --be--.

Column 4, lines 39 and 40, delete "overhand" and substitute --overhang--.

Signed and Sealed this

Twenty-second Day of August, 1989

*Attest:*

*Attesting Officer*

DONALD J. QUIGG

*Commissioner of Patents and Trademarks*